US008169460B2

(12) United States Patent
Furuichi et al.

(10) Patent No.: US 8,169,460 B2
(45) Date of Patent: May 1, 2012

(54) IMAGE FORMING APPARATUS

(75) Inventors: Yuusuke Furuichi, Osaka (JP); Nobuhiko Kita, Osaka (JP); Ryoh Idehara, Hyogo (JP); Kazuyoshi Kondo, Osaka (JP); Sei Onuma, Osaka (JP); Genta Hagiwara, Osaka (JP); Kaoru Tada, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 1009 days.

(21) Appl. No.: 12/149,212

(22) Filed: Apr. 29, 2008

(65) Prior Publication Data

US 2008/0279585 A1 Nov. 13, 2008

(30) Foreign Application Priority Data

May 11, 2007 (JP) ..... 2007-126496

(51) Int. Cl.
*B41J 2/435* (2006.01)
*B41J 2/385* (2006.01)
*B41J 27/00* (2006.01)

(52) U.S. Cl. ..... 347/263; 347/170; 347/257

(58) Field of Classification Search ..... 347/263, 347/170, 257
See application file for complete search history.

(56) References Cited

U.S. PATENT DOCUMENTS

| | | | | |
|---|---|---|---|---|
| 5,331,374 | A * | 7/1994 | Abe et al. | 399/124 |
| 6,219,508 | B1 * | 4/2001 | Nagatomi et al. | 399/125 |
| 6,785,502 | B2 | 8/2004 | Kondoh | |
| 2001/0008588 | A1 * | 7/2001 | Numazu et al. | 399/107 |
| 2007/0110473 | A1 | 5/2007 | Kondo et al. | |
| 2007/0110475 | A1 | 5/2007 | Idehara et al. | |
| 2007/0166073 | A1 | 7/2007 | Idehara et al. | |
| 2007/0246638 | A1 | 10/2007 | Idehara et al. | |
| 2008/0007935 | A1 | 1/2008 | Kondo et al. | |
| 2008/0050146 | A1 | 2/2008 | Kita et al. | |
| 2008/0063425 | A1 | 3/2008 | Idehara et al. | |
| 2008/0075502 | A1 | 3/2008 | Tada et al. | |

FOREIGN PATENT DOCUMENTS

| | | |
|---|---|---|
| JP | 5-042227 | 6/1993 |
| JP | 05-323686 | 12/1993 |
| JP | 2551765 | 6/1997 |
| JP | 2849978 | 11/1998 |
| JP | 2003-112446 | 4/2003 |
| JP | 2004-045585 | 2/2004 |
| JP | 2006-123455 | 5/2006 |
| JP | 3905268 | 1/2007 |

OTHER PUBLICATIONS

Abstract of JP 2001-134162 published May 18, 2001. Abstract of JP 07-209943 published Aug. 11, 1995.
Office Action mailed Apr. 15, 2011 for corresponding Japanese Patent Application No. 2007-126496.

* cited by examiner

*Primary Examiner* — Stephen D Meier
*Assistant Examiner* — Sarah Al Hashimi
(74) *Attorney, Agent, or Firm* — Harness, Dickey & Pierce, P.L.C.

(57) ABSTRACT

A holding unit turns, while holding a latent image writing unit, centered on a turning axis that is arranged on a main body of an image forming apparatus between an opening position and a closing position with respect to the main body. A positioning unit arranged on the main body positions the latent image writing unit with respect to the image carrier, when the holding unit is at the closing position. A biasing unit biases the latent image writing unit to make a contact with the positioning unit. A shock absorbing unit absorbs a shock received by the holding unit and the latent image writing unit when the holding unit is moved from the opening position to the closing position.

16 Claims, 11 Drawing Sheets

IMAGE FORMING APPARATUS

CROSS-REFERENCE TO RELATED APPLICATIONS

The present application claims priority to and incorporates by reference the entire contents of Japanese priority document, 2007-126496 filed in Japan on May 11, 2007.

BACKGROUND OF THE INVENTION

1. Field of the Invention

The present invention relates to an image forming apparatus such as a printer, a multi function peripheral (MFP), a facsimile etc., and, more particularly to an image forming apparatus that includes latent image-carrying members that bear latent images on an endlessly moving surface and a latent image writing unit that can move between a writing operation position for carrying out a writing operation to write the latent images on the surface and a retracting position when the writing operation is not carried out.

2. Description of the Related Art

In an existing electronographic image forming apparatus, a latent image writing unit such as a laser writer, which carries out optical scanning using a laser beam, writes latent images on latent image-carrying members such as uniformly charged photosensitive drums. Depending on a layout inside the image forming apparatus, the latent image writing unit becomes a hindrance, thus worsening maintainability of the latent image-carrying members and various peripheral devices such as developers that are arranged in the periphery of the latent image-carrying members.

In an image forming apparatus that is disclosed in Japanese Patent No. 2849978, the latent image writing unit is supported by an opening and closing cover that can be opened and closed with respect to a fixed cover that is a portion of a chassis of the image forming apparatus. Releasing the opening and closing cover significantly separates the latent image writing unit from the latent image-carrying members. Using the structure mentioned earlier enables to retract, along with a release of the opening and closing cover, the latent image writing unit from a position opposite the latent image-carrying members and to expose to outside the latent image-carrying members and the peripheral devices. Thus, maintainability of the latent image-carrying members and the peripheral devices can be enhanced.

However, in the image forming apparatus mentioned earlier, the opening and closing cover jolts against the fixed cover, thus causing occurrence of an error in relative positions of the latent image writing unit that is supported by the opening and closing cover and the latent image-carrying members that are supported by the fixed cover. Occurrence of the error reduces writing position accuracy of the latent image writing unit.

To overcome the drawback, the present applicant suggested an image forming apparatus that is disclosed in Application Filing No. 2006-008716 (hereinafter, "prior application"). To explain specifically, in the image forming apparatus disclosed in the prior application, a standard position member, which is included in the latent image writing unit that is held by the opening and closing cover, is biased by a biasing unit at the writing operation position when the opening and closing cover is closed and the standard position member is caused to touch a positioning unit inside the image forming apparatus. Due to this, a position of the latent image writing unit can be precisely decided with respect to the latent image-carrying members that are supported by the fixed cover inside the image forming apparatus. Thus, reduction of the writing position accuracy of the latent image writing unit can be curbed.

However, in the image forming apparatus that is disclosed in the prior application mentioned earlier, forcefully closing the opening and closing cover with respect to the fixed cover increases a shock when the standard position member collides with the positioning unit and is likely to cause significant warping of the opening and closing cover and the standard position member. If the opening and closing cover and the standard position member are significantly warped, because a warping amount is significant, the position of the latent image writing unit with respect to the latent image-carrying members cannot be precisely decided even if the biasing unit causes the standard position member to touch the positioning unit. Due to this, the writing position accuracy of the latent image writing unit is reduced.

SUMMARY OF THE INVENTION

It is an object of the present invention to at least partially solve the problems in the conventional technology.

According to an aspect of the present invention, there is provided an image forming apparatus including a photosensitive image carrier; a latent image writing unit that writes a latent image on the image carrier; a holding unit configured to turn, while holding the latent image writing unit, centered on a turning axis that is arranged on a main body of the image forming apparatus between an opening position and a closing position with respect to the main body; a positioning unit that is arranged on the main body and that positions the latent image writing unit with respect to the image carrier, when the holding unit is at the closing position; a first biasing unit that biases the latent image writing unit and causes the latent image writing unit to make a contact with the positioning unit; and a shock absorbing unit that absorbs a shock that is received by the holding unit and the latent image writing unit when the holding unit is moved from the opening position to the closing position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

A first embodiment of an electronographic printer (hereinafter, simply "printer") is explained below as an example of an image forming apparatus to which the present invention is applied.

Figure 2:
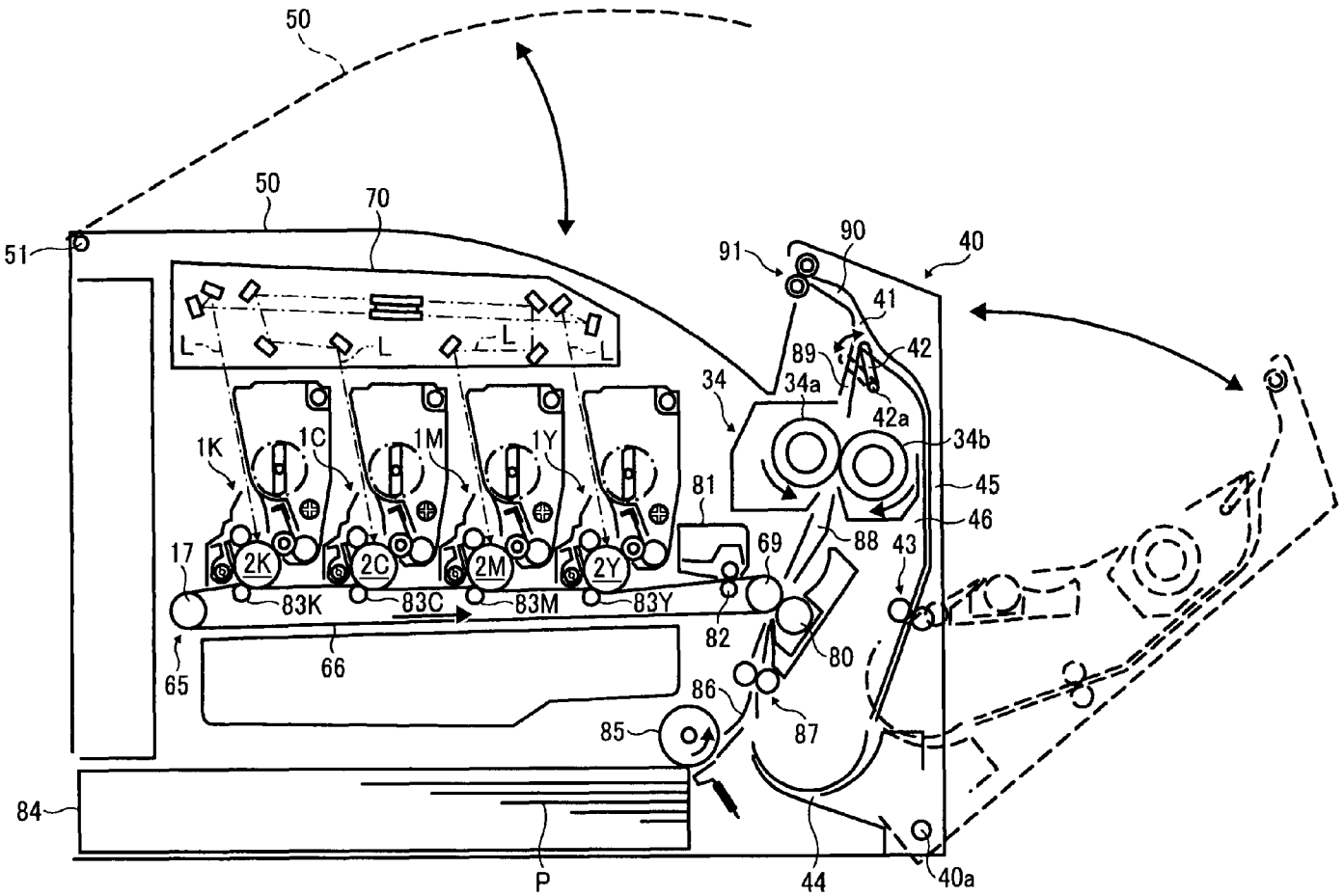
FIG. 2 is a schematic of an overview of a printer according to a first embodiment of the present invention.
Figure 3:
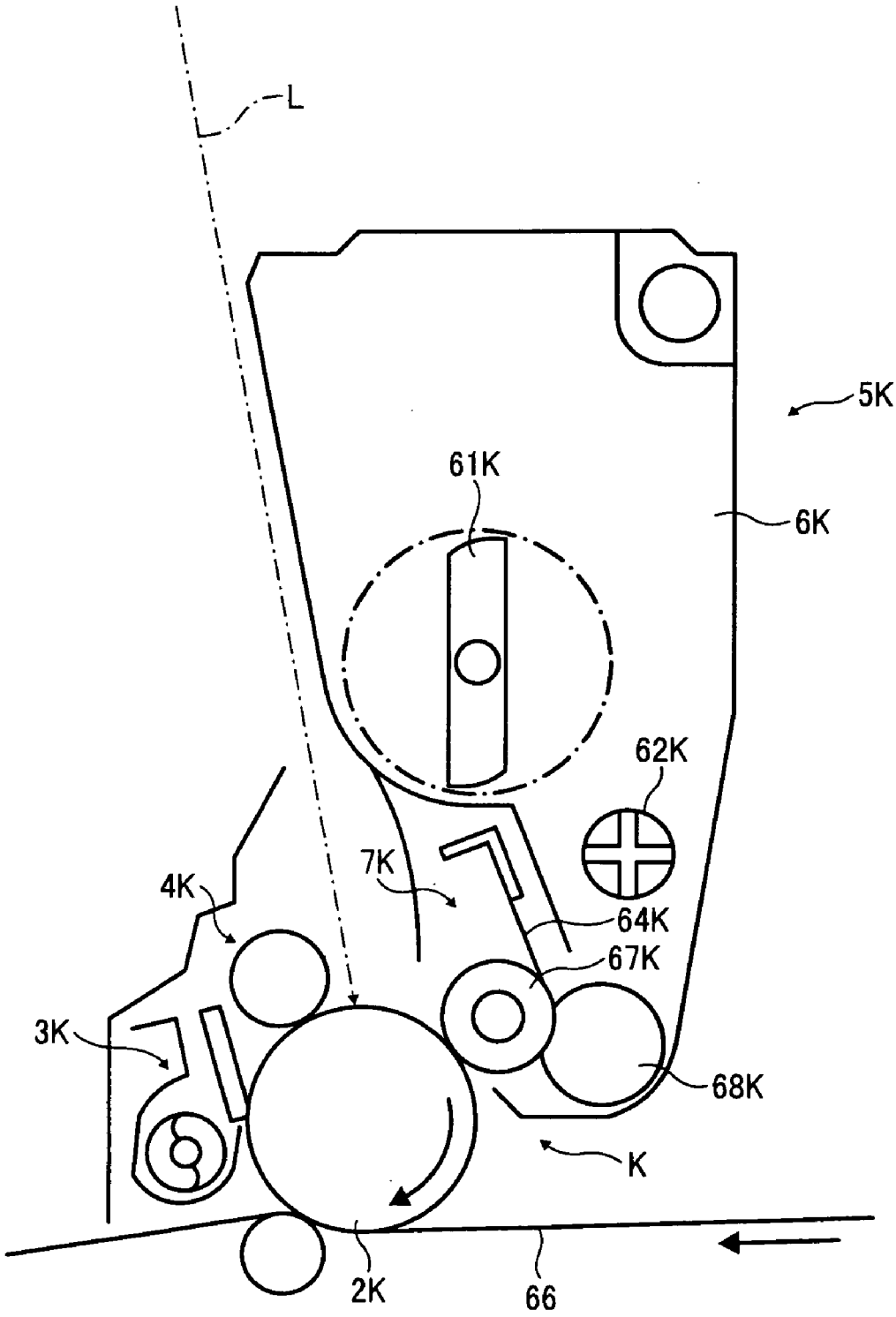
FIG. 3 is a schematic of a K processor of the printer shown in FIG. 2.

A basic structure of the printer is explained first. FIG. 2 is a schematic of an overview of the printer. As shown in FIG. 2, the printer includes four processors 1Y, 1C, 1M, and 1K for forming toner images of yellow, magenta, cyan, and black (hereinafter, "Y, M, C, and K") colors respectively. The processors 1Y, 1M, 1C, and 1K use mutually differing Y, M, C, and K toners respectively as image forming materials. However, the processors 1Y, 1M, 1C, and 1K include a similar structure and are replaced upon attainment of life span. The processor 1K which forms a K toner image is used as an example. As shown in FIG. 3, the processor 1K includes a photosensitive drum 2K that is a drum shaped latent image-carrying member, a drum cleaning device 3K, a not shown neutralizing device, a charging unit 4K, and a developer 5K. The processor 1K, which is an image forming unit, can be attached to and detached from a main body of the printer and worn out components can be replaced at the same time.

The charging unit 4K uniformly charges a surface of the photosensitive drum 2K that is rotated in a clockwise direction by a not shown driver. The uniformly charged surface of the photosensitive drum 2K is exposure scanned by a laser beam L and carries a K electrostatic latent image. The K electrostatic latent image is developed into a K toner image by the developer 5K that uses the not shown K toner. The K toner image is intermediate transferred onto an intermediate transfer belt 66 that is explained later. The drum cleaning device 3K removes a transfer residual toner that is adhering to the surface of the photosensitive drum 2K after an intermediate transfer process. The neutralizing device neutralizes a residual electric charge of the photosensitive drum 2K after cleaning. Due to neutralizing, the surface of the photosensitive drum 2K is initialized and is ready for next image formation. Similarly, in the other processors 1Y, 1M, and 1C, Y, M, and C toner images are formed on the photosensitive drums 2Y, 2M, and 2C respectively. The Y, C, and M toner images are intermediate transferred onto the intermediate transfer belt 66.

The developer 5K includes a vertically long hopper 6K, which houses therein the not shown K toner, and a developing unit 7K. The hopper 6K internally includes an agitator 61K, a stirring paddle 62K, and a toner supplying roller 68K. The agitator 61K is rotatably driven by a not shown driver. The stirring paddle 62K is rotatably driven by a not shown driver that is positioned in a vertically downward direction of the agitator 61K. The toner supplying roller 68K is rotatably driven by a not shown driver that is positioned in a vertically downward direction of the stirring paddle 62K. The K toner inside the hopper 6K is stirred due to rotatable driving of the agitator 61K and the stirring paddle 62K and moves, due to its own weight, towards the toner supplying roller 68K. The toner supplying roller 68K includes a metal cored bar and a roller that is formed of a resin foam that covers the surface of the metal cored bar. The toner supplying roller 68K rotates while adhering the K toner inside the hopper 6K to the surface of the roller.

The developing unit 7K of the developer 5K internally includes a developing roller 67K and a thinning blade 64K. The developing roller 67K rotates while touching the photosensitive drum 2K and the toner supplying roller 68K. A tip of the thinning blade 64K touches the developing roller 67K. The K toner, which adheres to the toner supplying roller 68K inside the hopper 6K, is supplied to the surface of the developing roller 67K by a touching portion of the developing roller 67K and the toner supplying roller 68K. Along with the rotations of the developing roller 67K, whenever the supplied K toner passes a touching position of the developing roller 67K and the thinning blade 64K, a layer thickness of the K toner on a roller surface is regulated. Next, the K toner after the layer thickness regulation adheres to the K electrostatic latent image on the surface of the photosensitive drum 2K in a developing area that is a touching portion of the developing roller 67K and the photosensitive drum 2K. Due to adhesion of the K toner, the K electrostatic latent image is developed into the K toner image.

The processor 1K for K color is explained with reference to FIG. 3. However, the other processors 1Y, 1M, and 1C also carry out similar process to form Y, M, and C toner images on the surface of the photosensitive drums 2Y, 2M, and 2C respectively.

As shown in FIG. 2, an optical writer 70 is arranged in a vertically downward direction of the processors 1Y, 1M, 1C, and 1K. Based on image data, the optical writer 70, which is a latent image writing unit, uses the laser beam L that is emitted from a laser diode to carry out optical scanning of the photosensitive drums 2Y, 2M, 2C, and 2K in the respective processors 1Y, 1M, 1C, and 1K. Due to the optical scanning, Y, M, C, and K electrostatic latent images are formed on the photosensitive drums 2Y, 2M, 2C, and 2K respectively. When carrying out the optical scanning, the optical writer 70 polarizes the laser beam L, which is emitted from an optical source by using a polygon mirror that is rotatably driven by a not shown polygon motor, and emits the laser beam L on the photosensitive drums 2 via a plurality of optical lenses and mirrors. A device can also be used that carries out optical writing by using a light emitting diode (LED) beam that is emitted from a plurality of LED of an LED array.

A transferring unit 65 is arranged in a vertically downward direction of the processors 1Y, 1M, 1C, and 1K. The endless intermediate transfer belt 66 is stretched on the transferring unit 65 and endlessly moves in a counterclockwise direction.

Apart from the intermediate transfer belt 66, the transferring unit 65 includes a driving roller 17, a driven roller 69, four primary transferring rollers 83Y, 83M, 83C, and 83K, a secondary transferring roller 80, a belt cleaning device 81, and a cleaning backup roller 82.

The intermediate transfer belt 66 is stretched on the driving roller 17, the driven roller 69, the cleaning backup roller 82, and the primary transferring rollers 83Y, 83M, 83C, and 83K. Due to rotations of the driving roller 17, which is rotatably driven in the counterclockwise direction by a not shown driver, the intermediate transfer belt 66 endlessly moves in the counterclockwise direction.

The endlessly moving intermediate transfer belt 66 is sandwiched between the four primary transferring rollers 83Y, 83M, 83C, and 83K and the photosensitive drums 2Y, 2M, 2C, and 2K respectively. Due to sandwiching of the intermediate transfer belt 66, primary transfer nips for Y, M, C, and K colors are formed where a front surface of the intermediate transfer belt 66 touches the photosensitive drums 2Y, 2M, 2C, and 2K respectively.

A not shown transfer bias power source applies a primary transfer bias to the primary transferring rollers 83Y, 83M, 83C, and 83K. Due to this, a transfer electric field is formed between the electrostatic latent images on the photosensitive drums 2Y, 2M, 2C, and 2K and the primary transferring rollers 83Y, 83M, 83C, and 83K respectively. Transfer charging units or transfer brushes can also be used instead of the primary transferring rollers 83Y, 83M, 83C, and 83K.

Along with the rotations of the photosensitive drum 2Y, when the Y toner, which is formed on the surface of the photosensitive drum 2Y of the Y processor 1Y, enters the primary transfer nip for Y color, the Y toner is primary transferred from the photosensitive drum 2Y onto the intermediate transfer belt 66 due to the transfer electric field and a nip pressure. When the endlessly moving intermediate transfer belt 66 that includes the primary transferred Y toner image passes the primary transfer nips for M, C, and K colors, the M, C, and K toner images on the photosensitive drums 2M, 2C, and 2K respectively are sequentially overlapped on the Y toner image and are primary transferred. Due to such an overlapped primary transfer, a four color toner image is formed on the intermediate transfer belt 66.

The secondary transferring roller 80 of the transferring unit 65 is arranged on the outer side of the loop of the intermediate transfer belt 66. Due to this, the intermediate transfer belt 66 is sandwiched between the secondary transferring roller 80 and the driven roller 69 on the inner side of the loop. Thus, secondary transfer nips are formed where the front surface of the intermediate transfer belt 66 touches the secondary transferring roller 80. A not shown transfer bias power source applies a secondary transfer bias to the secondary transferring roller 80. Due to this, a secondary transfer electric field is formed between the secondary transferring roller 80 and the driven roller 69 that is connected the ground.

A sheet feeding cassette 84 is arranged in a vertically downward direction of the transferring unit 65 such that the sheet feeding cassette 84 can be attached to or detached from a chassis of the printer. The sheet feeding cassette 84 houses therein a bundle of a plurality of recording sheets P. The sheet feeding cassette 84 causes a sheet feeding roller 85 to touch the uppermost recording sheet P in the bundle and causes the sheet feeding roller 85 to rotate in a counterclockwise direction at a predetermined timing to transmit the recording sheet P towards a sheet feeding path 86.

A pair of registration rollers 87 is arranged near an end of the sheet feeding path 86. When the recording sheet P, which is transmitted from the sheet feeding cassette 84, is sandwiched between the pair of the registration rollers 87, the registration rollers 87 immediately stop rotating. Next, the registration rollers 87 resume rotatable driving at a timing that is synchronous with the four color toner image on the intermediate transfer belt 66 in the secondary transfer nip and transmit the recording sheet P towards the secondary transfer nip.

The four color toner image on the intermediate transfer belt 66, which adheres to the recording sheet P in the secondary transfer nip, is bulk secondary transferred onto the recording sheet P due to the secondary transfer electric field and the nip pressure. The four color toner image merges with the white color of the recording sheet P and becomes a full color toner image. Upon passing the secondary transfer nip, the recording sheet P, which includes the full color toner image formed on the surface, is curvature separated from the secondary transferring roller 80 and the intermediate transfer belt 66. Next, the recording sheet P is transmitted via a post transfer-transportation path 33 to a fixing device 34 that is explained later.

The transfer residual toner which is not transferred to the recording sheet P is adhering to the intermediate transfer belt 66 that has passed the secondary transfer nip. The belt cleaning device 81, which touches the front surface of the intermediate transfer belt 66, cleans the transfer residual toner from the belt surface. The cleaning backup roller 82, which is arranged on the inner side of the loop of the intermediate transfer belt 66, backs up from the inner side of the loop, the belt cleaning by the belt cleaning device 81.

The fixing device 34 forms a fixing nip between a fixing roller 34*a* and a pressurizing roller 34*b*. The fixing roller 34*a* internally includes a heating source such as a not shown halogen lamp. The pressurizing roller 34*b* rotates while touching the fixing roller 34*a* at a predetermined pressure. The recording sheet P, which is transmitted to inside the fixing device 34, is sandwiched between the fixing nip such that an unfixed toner image carrying surface of the recording sheet P adheres to the fixing roller 34*a*. The toner in the toner image softens due to addition of heat and pressure and the full color image is fixed.

The recording sheet P which is ejected from inside the fixing device 34 passes via a post fixing-transportation path 89 and enters a branching point of an ejection path 90 and a pre-reversion transportation path 41. A switching pawl 42, which rotatably drives centered on a turning shaft 42*a*, is arranged in a side direction of the post fixing-transportation path 89. Rotation of the switching pawl 42 closes or opens an end vicinity of the post fixing-transportation path 89. During the timing when the recording sheet P is transmitted from the fixing device 34, the switching pawl 42 stops at a rotating position that is indicated by a continuous line shown in FIG. 2, thereby opening the end vicinity of the post fixing-transportation path 89. Due to this, the recording sheet P progresses to inside the ejection path 90 from the post fixing-transportation path 89 and is sandwiched between a pair of ejecting rollers 91.

Based on an input operation on an operating unit, which includes a not shown numerical keypad, and control signals that are transmitted from a not shown personal computer, if a single surface print mode is set, the recording sheet P sandwiched between the ejecting rollers 91 is ejected outside the printer. Next, the ejected recording sheet P is stacked in a stacking unit that is an upper surface of an upper cover 50 of the chassis.

If a both surfaces printing mode is set, a back end side of the recording sheet P, which is transported to inside the ejection path 90, passes through the post fixing-transportation path 89 while a tip of the recording sheet P is sandwiched between the ejecting rollers 91, and the switching pawl 42 rotates to a position that is indicated by a dotted line shown in FIG. 2, thus closing the end vicinity of the post fixing-transportation path 89. Nearly simultaneously, the ejecting rollers 91 start rotating reversely. Due to this, the recording sheet P is transported such that the back end side of the recording sheet P is turned towards the front and the recording sheet P progresses to inside the pre-reversion transportation path 41.

A front side of the printer is shown in FIG. 2. A front side of a perpendicular direction to a paper surface shown in FIG. 2 is a front surface of the printer and a back side is a back surface. Further, a right side of the printer shown in FIG. 2 is a right surface and a left side is a left surface. A right end portion of the printer is a reversing unit 40 that turns centered on a turning axis 40*a*. Due to this, the reversing unit 40 can be opened or closed with respect to a main body of the chassis. When the ejecting rollers 91 inversely rotate, the recording sheet P progresses to inside the pre-reversion transportation path 41 of the reversing unit 40 and is transported towards a lower side from an upper side in the perpendicular direction. After passing a pair of reverse transporting rollers 43, the recording sheet P progresses to inside a reverse transportation path 44 that is curved in a semicircular shape. Because the recording sheet P is transported along the curved shape, the upper surface and the lower surface of the recording sheet P are reversed, a progression direction of the recording sheet P from the upper side in the perpendicular direction towards the lower side is also reversed, and the recording sheet P is transported from the lower side in the perpendicular direction towards the upper side. Next, the recording sheet P reprogresses to the secondary transfer nip via inside of the sheet feeding path 86. After the full color image is bulk secondary transferred on the other surface of the recording sheet P, the recording sheet P sequentially passes a post transfer-transportation path 88, the fixing device 34, the post fixing-transportation path 89, the ejection path 90, and the ejecting rollers 91, and is ejected outside the printer.

The reversing unit 40 includes an external cover 45 and a swinging member 46. To be specific, the external cover 45 of the reversing unit 40 is supported such that the external cover 45 turns centered on the turning axis 40*a* that is arranged in the chassis of the main body of the printer. Due to turning, the external cover 45 opens and closes, along with the internally held swinging member 46, with respect to the chassis. As indicated by the dotted line shown in FIG. 2, when the external cover 45 and the internally held swinging member 46 open, the sheet feeding path 86, the secondary transfer nip, the post transfer-transportation path 88, the post fixing-transportation path 89, and the ejection path 90, which are arranged between the reversing unit 40 and the main body of the printer, are longitudinally divided into two and are exposed to outside. Due to this, a jammed sheet inside the sheet feeding path 86, the secondary transfer nip, the post transfer-transportation path 88, the post fixing-transportation path 89, and the ejection path 90 can be easily removed.

Further, the swinging member 46 is supported by the external cover 45 such that when the external cover 45 is opened, the swinging member 46 turns centered on a not shown swinging axis that is arranged in the external cover 45. Due to turning, when the swinging member 46 opens with respect to the external cover 45, the pre-reversion transportation path 41 and the reverse transportation path 44 are longitudinally divided into two and are exposed to outside. Due to this, the jammed sheet inside the pre-reversion transportation path 41 and the reverse transportation path 44 can be easily removed.

As indicated by the arrow shown in FIG. 2, the upper cover 50 of the chassis of the printer is turnably supported centered on an axis member 51. Rotating the upper cover 50 in the counterclockwise direction opens the upper cover 50 with respect to the chassis. Thus, an upper portion opening of the chassis is widely exposed.

Figure 4:
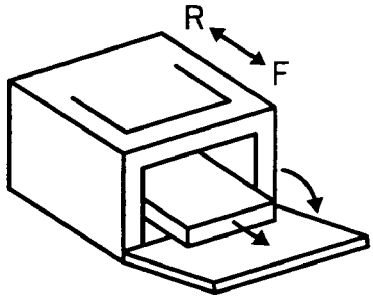
FIG. 4 is a schematic of an example of an image forming apparatus in which maintenance of internal components is carried out using a front cover opening method.
Figure 5:
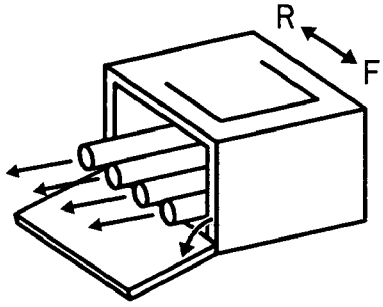
FIG. 5 is a schematic of an example of the image forming apparatus in which maintenance of the internal components is carried out using a left cover opening method.
Figure 6:
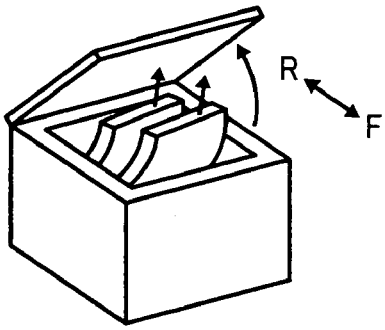
FIG. 6 is a schematic of an example of the image forming apparatus in which maintenance of the internal components is carried out using an upper cover opening method.

However, in recently used image forming apparatuses, it is desirable to remove internal components and devices of the image forming apparatus without affecting compactness, light weight, and operability of the image forming apparatus. As shown in FIG. 4, a front cover which is arranged in a front side end (end in a direction of an arrow F shown in FIG. 4) of the chassis of the image forming apparatus can be opened as a removing method of the internal components and the devices. Alternatively, as shown in FIG. 5, a left cover which is arranged in a left side end of the chassis can also be opened as the removing method. As shown in FIG. 6, for the internal components and the devices having a comparatively high frequency of removal, opening an upper cover is desirable. Due to this, removing operation can be confirmed while viewing the inside of the chassis from the upper side without squatting down, bending one's waist, or bending down. Thus, workload can be reduced and occurrence of operational errors can be curbed. Further, because the upper portion of the image forming apparatus is likely to be a position of enhanced visibility, the upper portion is often used as an ejecting tray or a scanner is mounted on the upper portion.

In the printer according to the embodiment, the four processors 1Y, 1M, 1C, and 1K shown in FIG. 2 are explained as representative examples of the devices having a comparatively high frequency of removal. Because the processors 1Y, 1M, 1C, and 1K are replaced at the time of depletion of the toner in the respective developers 5Y, 5M, 5C, and 5K, the processors 1Y, 1M, 1C, and 1K are frequently removed. If an upper cover opening method shown in FIG. 6 is to be used for removing the processors 1Y, 1M, 1C, and 1K, arranging the processors 1Y, 1M, 1C, and 1K horizontally is the most important layout condition of each of the processors 1Y, 1M, 1C, and 1K. If the processors 1Y, 1M, 1C, and 1K are arranged vertically instead of horizontally, for replacing the third processor from the top, for example, the first and the second processor that do not need to be replaced are also required to be removed along with the third processor. Thus, operability is significantly worsened.

As shown in FIG. 2, if a horizontal layout is used for the four processors 1Y, 1M, 1C, and 1K, the intermediate transfer belt 66 needs to be horizontally stretched such that the intermediate transfer belt 66 touches the photosensitive drums 2Y, 2M, 2C, and 2K. Further, as shown in FIG. 2, the four horizontal processors 1Y, 1M, 1C, and 1K can be arranged in the vertically upward direction of the horizontally long intermediate transfer belt 66. Alternatively, the four horizontal processors 1Y, 1M, 1C, and 1K can also be arranged in the downward direction of the intermediate transfer belt 66. If the four horizontal processors 1Y, 1M, 1C, and 1K are arranged in the downward direction of the intermediate transfer belt 66, the optical writer 70 needs to be arranged horizontally in the downward direction of the processors 1Y, 1M, 1C, and 1K to enable the optical writer 70 to optically scan the four photosensitive drums 2Y, 2M, 2C, and 2K. Thus, in a reverse layout of the layout shown in FIG. 2, the optical writer 70, the processors 1Y, 1M, 1C, and 1K, and the intermediate transfer belt 66 are sequentially overlapped from the lower side in the vertical direction towards the upper side. However, if the recording sheet P is to be transported from the lower side in the vertical direction towards the upper side, the fixing device 34 needs to be arranged in a further upward direction than the intermediate transfer belt 66 that forms the secondary transfer nip. Due to this, if the layout mentioned earlier is used, the left side of the fixing device 34 becomes a blank space. Thus, achieving compactness and conservation of space for the image forming apparatus becomes difficult.

Thus, as shown in FIG. 2, in the layout used in the printer according to the embodiment, the four processors 1Y, 1M, 1C, and 1K are horizontally arranged in the upward direction of the horizontally long intermediate transfer belt 66. As shown in FIG. 2, in the layout mentioned earlier, the horizontally long optical writer 70 is arranged in the upward direction of the four processors 1Y, 1M, 1C, and 1K. Further, the four processors 1Y, 1M, 1C, and 1K and the optical writer 70 are arranged in a lateral direction of the fixing device 34. Thus, occurrence of the blank space can be avoided.

Even if the horizontally arranged processors 1Y, 1M, 1C, and 1K are arranged either in the upward direction or in the downward direction of the horizontally long intermediate transfer belt 66, the optical writer 70 needs to be retracted from a position opposite to the processors 1Y, 1M, 1C, and 1K before carrying out a removing operation on the processors 1Y, 1M, 1C, and 1K. In the printer according to the embodiment, for example, if the processors 1Y, 1M, 1C, and 1K are arranged in the upward direction of the intermediate transfer belt 66, the optical writer 70 is arranged in the upward direction of the processors 1Y, 1M, 1C, and 1K. In such a layout, even if the upper cover 50 is opened with respect to the chassis, the optical writer 70 becomes a hindrance and the processors 1Y, 1M, 1C, and 1K cannot be exposed. Thus, before carrying out the removing operation on the processors 1Y, 1M, 1C, and 1K, the optical writer 70 needs to be retracted from immediately above the processors 1Y, 1M, 1C, and 1K.

Thus, in the printer according to the embodiment, for achieving compactness and conservation of space, the processors 1Y, 1M, 1C, and 1K are arranged in the upward direction of the intermediate transfer belt 66 and the optical writer 70 is arranged further above the processors 1Y, 1M, 1C, and 1K. Due to this, the optical writer 70 needs to be retracted from immediately above the processors 1Y, 1M, 1C, and 1K. In a method which is used in the printer according to the embodiment to open the upper cover 50, for retracting the optical writer 70, one end side of the optical writer 70 is turnably supported by a frame inside the chassis and the optical writer 70 is turned like an opening and closing door, thus enabling to retract the optical writer 70 from immediately above the processors 1Y, 1M, 1C, and 1K or to set the optical writer 70 immediately above the processors 1Y, 1M, 1C, and 1K. Alternatively, the optical writer 70 can be held on a lower surface side of the upper cover 50 that can be opened and closed, and along with opening and closing of the upper cover 50, the optical writer 70 can be retracted from immediately above the processors 1Y, 1M, 1C, and 1K or set immediately above the processors 1Y, 1M, 1C, and 1K.

However, regardless of any structure that is used, jolting of the optical writer 70 that can slidably move or turn and jolting of the upper cover 50 causes occurrence of an error in relative positions of the optical writer 70 and the photosensitive drums 2Y, 2M, 2C, and 2K inside the chassis. Due to the error, a writing position accuracy of the optical writer 70 is reduced. Reduction in the writing position accuracy causes image blurring, image omission, image vignetting etc. Moreover, in the printer according to the embodiment that includes the multiple processors 1Y, 1M, 1C, and 1K, reduction in the writing position accuracy also causes color misalignment.

A structure, which is a salient feature of the printer according to the embodiment, is explained next.

Figure 7:
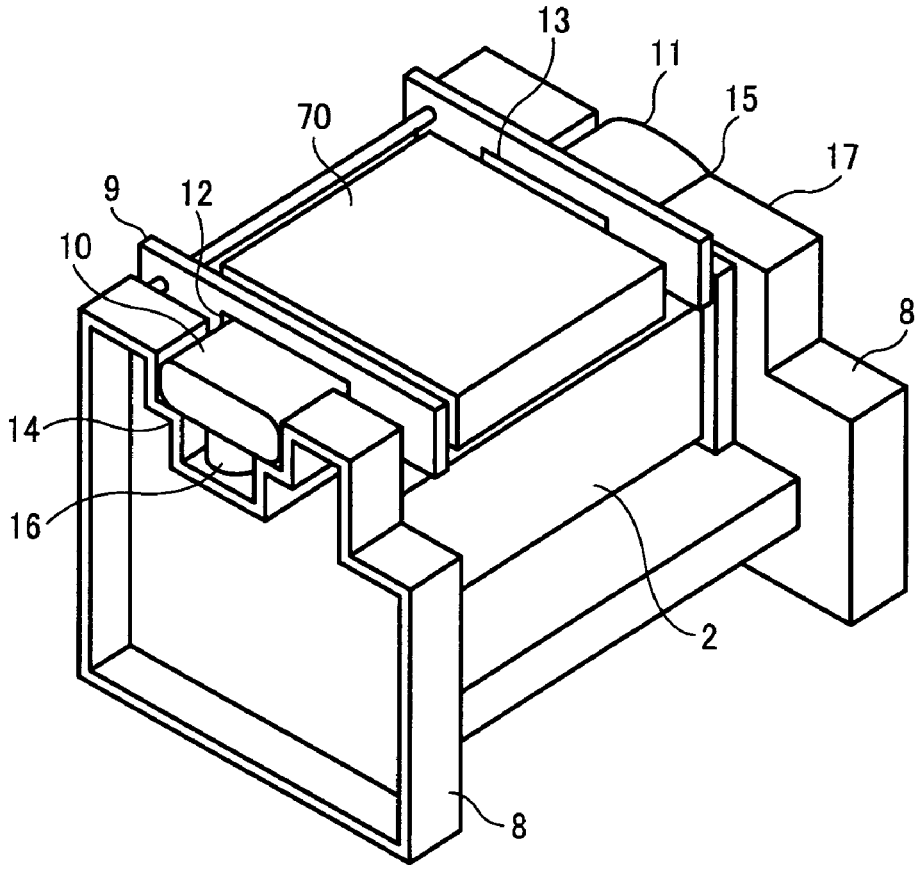
FIG. 7 is a schematic of the printer when an optical writer and an upper frame are at a writing operation position.
Figure 8:
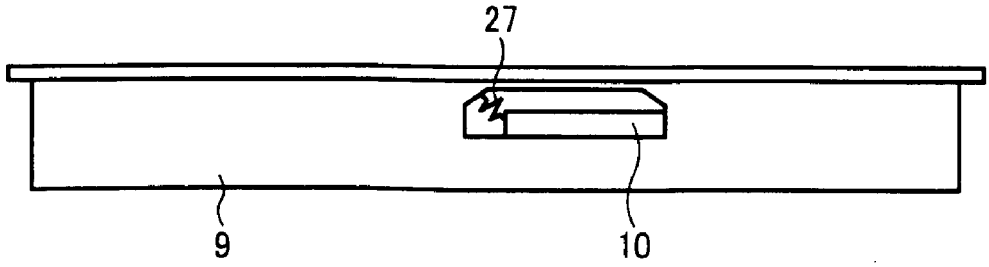
FIG. 8 is a schematic of an overview of a fixing position of a spring that biases a supporting unit.

The optical writer 70, which is at a writing operation position at the time of carrying out operations such as image formation, the photosensitive drums 2, main frames 8, and an upper frame 9 are shown in FIG. 7. Supporting units 10 and 11 of the optical writer 70 respectively penetrate holding brackets 12 and 13 of the upper frame 9 and engage with holding units 14 and 15 respectively that are positioning units arranged on the main frames 8. Thus, the holding units 14 and 15 hold the supporting units 10 and 11 respectively. When being held by the respective holding units 14 and 15, the supporting units 10 and 11 of the optical writer 70 press air cylinders 16 and 17 respectively. Further, the supporting units 10 and 11 penetrate the holding brackets 12 and 13 at a predetermined gap. For example, as shown in FIG. 8, a spring 27 biases the supporting unit 10 and causes the supporting unit 10 to touch the holding unit 14 of the main frame 8. Similarly, the spring 27 is also arranged on the side of the supporting unit 11 and causes the supporting unit 11 to touch the holding unit 15. Due to this, a position of the optical writer 70 with respect to the main frames 8 can be precisely determined without getting affected by a position precision of the upper frame 9. Thus, reduction in the writing position accuracy of the optical writer 70 can be curbed.

Figure 9:
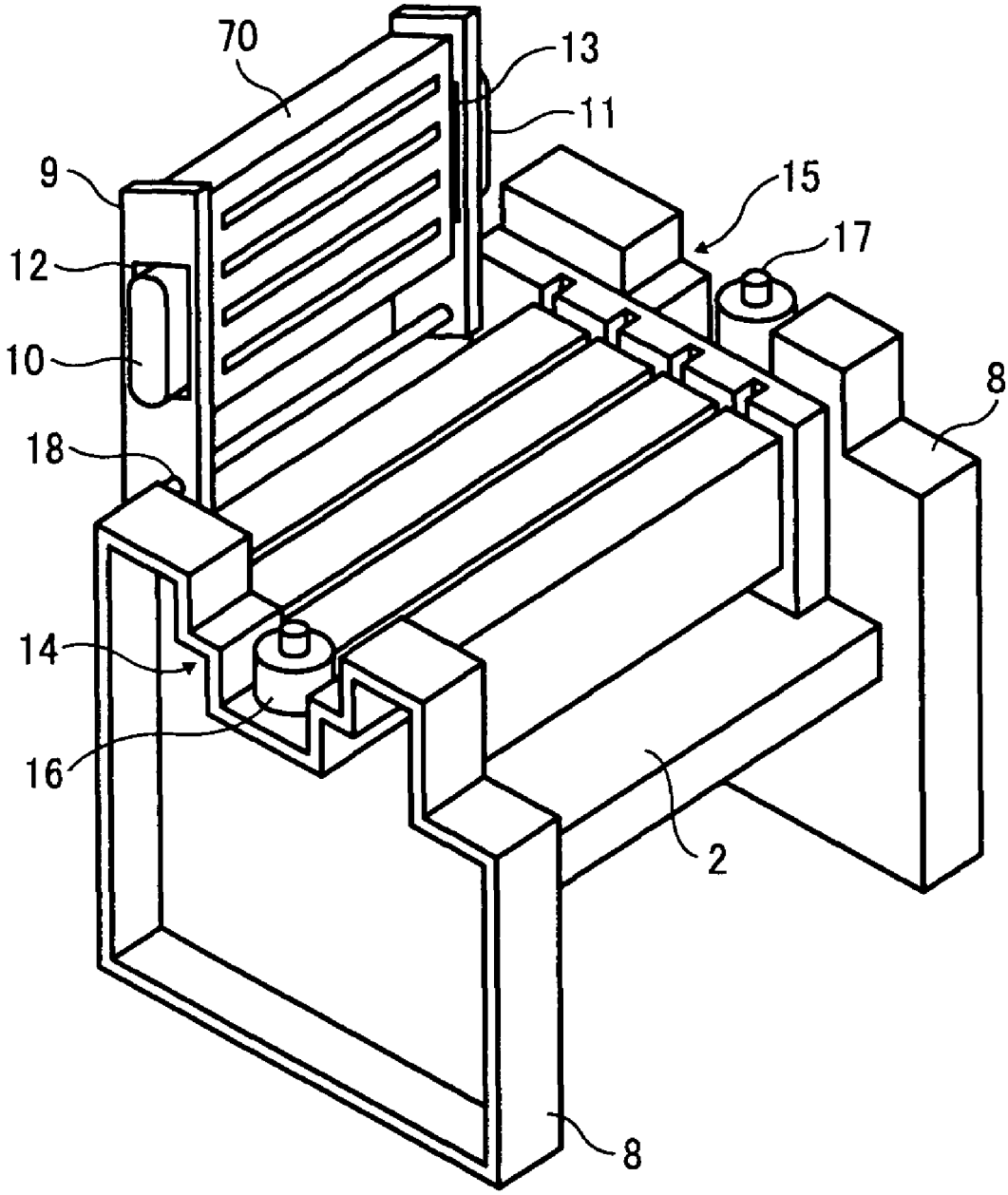
FIG. 9 is a schematic of the printer when the optical writer and the upper frame are at a retracting position.

Moving the optical writer 70 to a retracting position by turning the optical writer 70 with respect to the main frames 8 is explained with reference to FIG. 9. Both the ends of a fulcrum shaft 18 are supported by the main frames 8 and the fulcrum shaft 18 turnably pivotally supports the upper frame 9. The spring 27 causes the supporting units 10 and 11 to touch a periphery of the holding brackets 12 and 13 respectively. Due to this, when moving the optical writer 70 from the writing operation position to the retracting position, the optical writer 70 and the upper frame 9 can be turned together while curbing severe jolting of the optical writer 70. Thus, when the upper frame 9 is closed with respect to the main frames 8, occurrence of warping or deformation due to the upper frame 9 and the optical writer 70 receiving a severe shock can be curbed.

Because structures of the supporting unit 10 and the supporting unit 11 are basically the same unless specified otherwise, only the supporting unit 10 is explained and an explanation of the supporting unit 11 is omitted.

Figure 1:
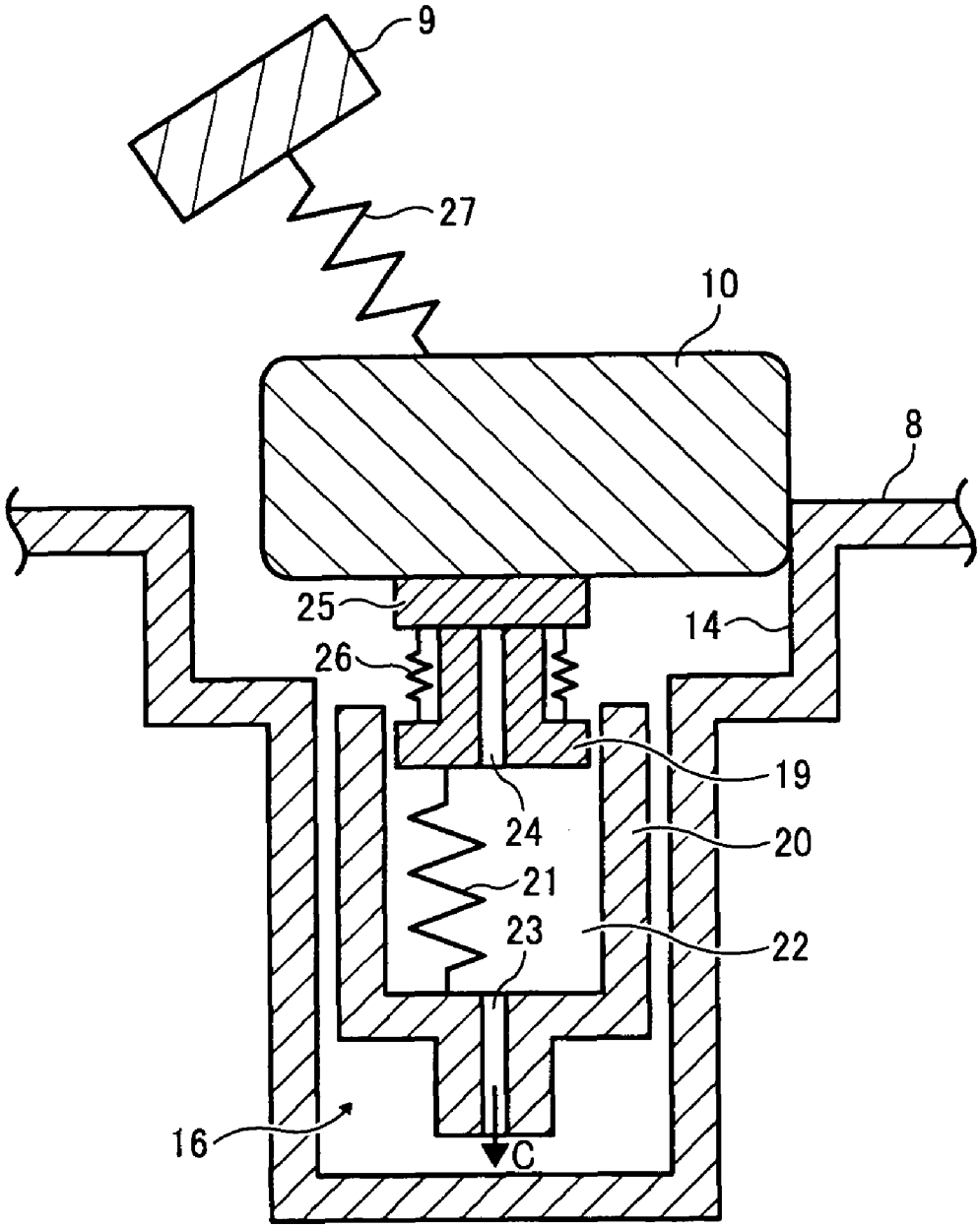
FIG. 1 is a schematic of an overview of a salient feature of the present invention.

FIG. 1 is a schematic of a condition in the vicinity of the air cylinder 16 when the optical writer 70 is being moved to the writing operation position. The air cylinder 16 includes a piston 19, a cylinder 20, a cylinder biasing spring 21, a compression chamber 22, an orifice 23, a communicating hole 24, a communicating hole-opening/closing member 25, and a spring 26. The cylinder biasing spring 21 biases the piston 19 in a pulling-apart direction from the cylinder 20. The piston 19 is pressed against the compression chamber 22, thus reducing a volume of the compression chamber 22. The orifice 23 communicates between the compression chamber 22 and the outside. The communicating hole 24 communicates between the compression chamber 22 and the outside separately from the orifice 23. The communicating hole-opening/closing member 25 opens and closes the communicating hole 24. The spring 26 biases the communicating hole-opening/closing member 25 in an opening direction of the communicating hole 24.

A process to restore the optical writer 70 from the retracting position to the writing operation position is explained next. First, the supporting unit 10 of the optical writer 70 presses the communicating hole-opening/closing member 25 to close the communicating hole 24. Next, the supporting unit 10 presses the piston 19 via the communicating hole-opening/closing member 25. The compression chamber 22 is compressed due to pressing of the piston 19 and air inside the compression chamber 22 is released in the direction of an arrow C via the orifice 23. If a user attempts to rapidly restore the optical writer 70 from the retracting position to the writing operation position, because the amount of air released from inside the compression chamber 22 via the orifice 23 is less, a pressure inside the compression chamber 22 increases. Due to the pressure inside the compression chamber 22 and the cylinder biasing spring 21, a bias force acts in a push-up direction of the supporting unit 10. The bias force enables to absorb a shock when the air cylinder 16 causes the supporting unit 10 to touch the holding unit 14 of the main frame 8.

Figure 10:
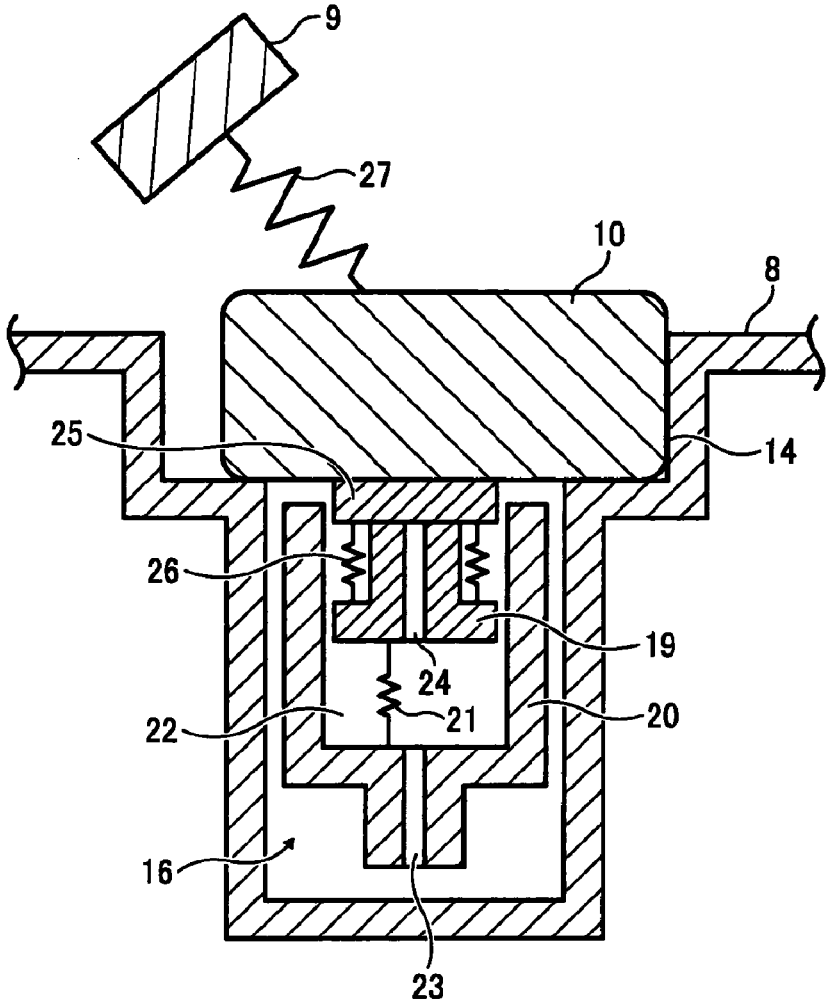
FIG. 10 is a schematic of the supporting unit that is held by a holding unit.

Further, the piston 19 is pressed and the air inside the compression chamber 22 is released in the direction of the arrow C via the orifice 23, thus gradually reducing the pressure inside the compression chamber 22 and also reducing the bias force that causes the air cylinder 16 to push up the supporting unit 10. Next, as shown in FIG. 10, when the supporting unit 10 of the optical writer 70 is held by the holding unit 14 of the main frame 8 and the pressure inside the compression chamber 22 gradually reduces and nearly becomes zero, the bias force that is biased on the supporting unit 10 is provided only by a weight of the spring 27 and the upper frame 9 and by the cylinder biasing spring 21. Thus, fulfilling a relation "the bias force of the spring 27+the weight of the upper frame 9>the bias force of the cylinder biasing spring 21 (the air cylinder 16)" enables to precisely decide the position of the optical writer 70 in the holding unit 14 of the main frame 8.

Thus, even if the bias force of the cylinder biasing spring 21 (the air cylinder 16) is larger than the bias force of the spring 27, fulfilling the relation mentioned earlier enables to press the supporting unit 10 of the optical writer 70 against the holding unit 14 and enables to precisely decide the position of the optical writer 70. However, the bias force of the spring 27 is set to be larger than the bias force of the cylinder biasing spring 21. Due to this, a displacement in the position of the optical writer 70 due to vibrations of the image forming apparatus during image formation or vibrations during transportation can be curbed and the position of the optical writer 70 can be precisely decided.

Further, even if the bias force of the spring 26 is larger than the bias force of the spring 27, fulfilling a relation "the bias force of the spring 27+the weight of the upper frame 9>the bias force of the biasing spring 26" enables to press the supporting unit 10 of the optical writer 70 against the holding unit 14 and enables to precisely decide the position of the optical writer 70. Especially, the bias force of the spring 27 is set to be larger than the bias force of the spring 26. Due to this, a displacement in the position of the optical writer 70 due to vibrations of the image forming apparatus during image formation or vibrations during transportation can be curbed and the position of the optical writer 70 can be precisely decided.

Thus, when suddenly restoring the optical writer 70 from the retracting position to the writing operation position, the air cylinder 16 exerts a significant bias force on the supporting unit 10, absorbs the shock, and slowly restores the optical writer 70 to the writing operation position. Subsequently, the bias force of the air cylinder 16 gradually reduces, thus enabling to precisely decide the position of the optical writer 70 against the holding unit 14 by using the bias force of the spring 27.

Figure 11:
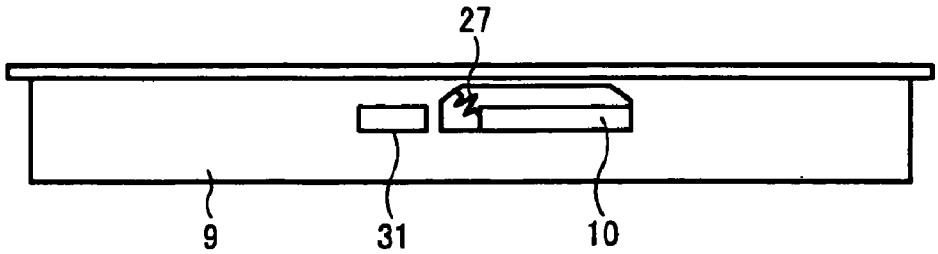
FIG. 11 is a schematic of an overview of the upper frame when a protruding unit is arranged on the upper frame.

In the present embodiment, the shock can be absorbed by pressing the air cylinder 16 against the supporting unit 10 of the optical writer 70. Further, as shown in FIG. 11, a protruding unit 31 can also be arranged on the upper frame 9 and the shock can be absorbed by pressing the air cylinder 16 using the protruding unit 31. However, similarly as in the present embodiment, using the supporting unit 10, which is used to decide the position of the optical writer 70, to press the air cylinder 16 removes a necessity to arrange the protruding unit 31 on the upper frame 9. Thus, a cost of the image forming apparatus can be reduced.

Figure 12:
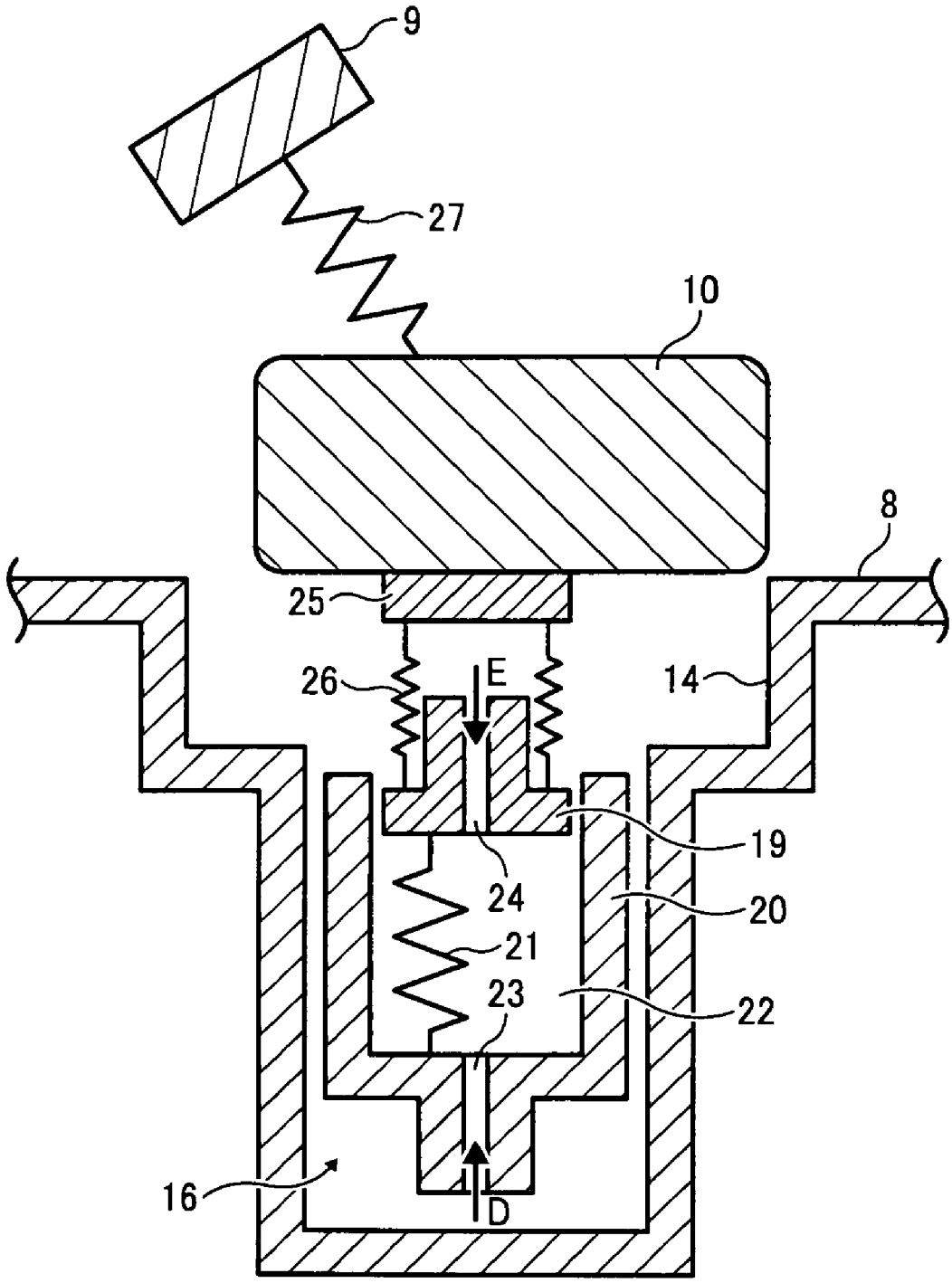
FIG. 12 is a schematic of a vicinity of an air cylinder when the optical writer and the upper frame are moved from the writing operation position to the retracting position.

FIG. 12 is a schematic of the vicinity of the air cylinder 16 when the optical writer 70 is moved from the writing operation position to the retracting position. When the optical writer 70 is moved in the upward direction of the writing operation position for moving to the retracting position, the communicating hole-opening/closing member 25 is pushed up due to a restoring force of the spring 26 and the communicating hole 24 opens. Thus, in the present embodiment, the communicating hole 24 can be opened by pushing up the communicating hole-opening/closing member 25 using the spring 26, thereby removing a necessity to include an exclusive actuator for driving the communicating hole-opening/closing member 25 that opens and closes the communicating hole 24. Due to this, a cost of the image forming apparatus can be reduced and an internal structure of the image forming apparatus can be simplified.

When the communicating hole 24 is opened, air is simultaneously brought inside the compression chamber 22 from the orifice 23 and the communicating hole 24 in directions of arrows D and E respectively. In other words, including the communicating hole 24 along with the orifice 23 causes a rapid transmission of the air from the outside to inside the compression chamber 22 compared to when only the orifice 23 is included. Due to this, the space inside the compression chamber 22 expands and the bias force of the air cylinder 16 can be rapidly restored. Thus, rapidly restoring the bias force of the air cylinder 16 enables to quickly deal with the shock when the optical writer 70 is again moved from the retracting position to the writing operation position.

Figure 13:
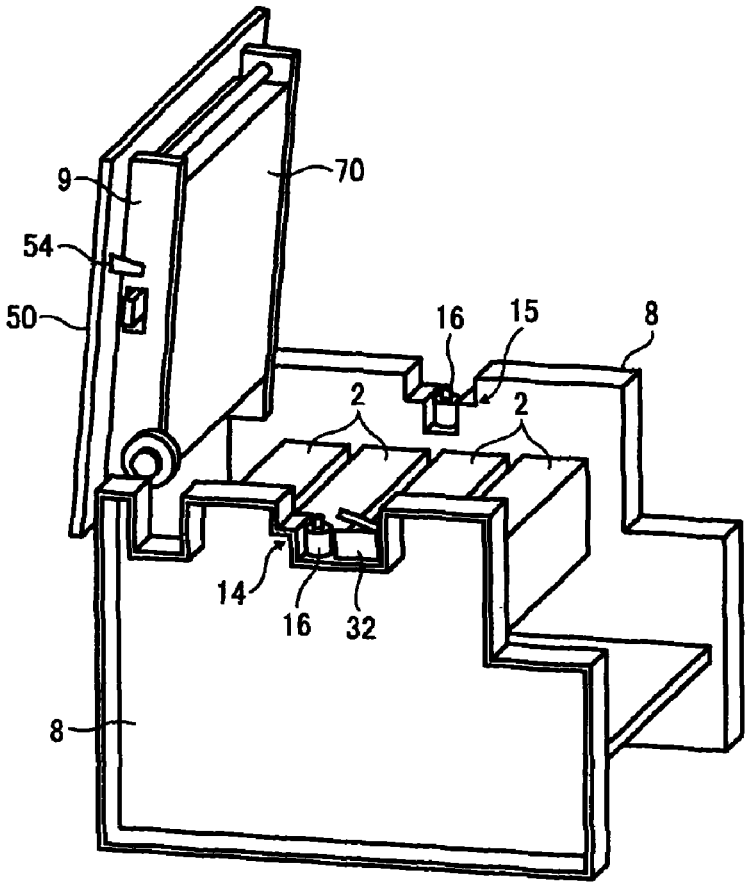
FIG. 13 is a schematic of a printer according to a second embodiment of the present invention.
Figure 14:
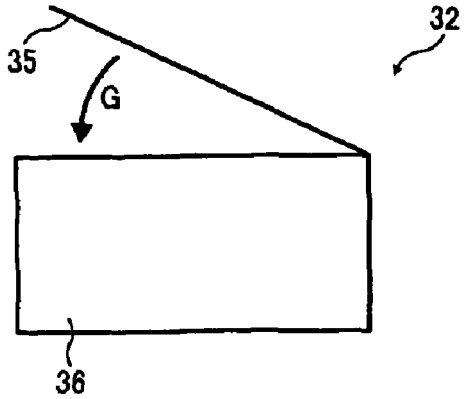
FIG. 14 is a schematic of an overview of an interlock switch.

A basic structure according to a second embodiment of the present invention is the same as the basic structure according to the first embodiment. However, as shown in FIG. 13, in addition to the structure explained in the first embodiment, the upper frame 9 includes a torque limiter 28 that includes a gear 29 and the main frames 8 includes a rack 30 that meshes with the gear 29 of the torque limiter 28. Arranging the torque limiter 28 on the upper frame 9 instead of arranging the torque limiter 28 on the main frame 8 enables to effectively use space and enables to enhance compactness of the image forming apparatus. Further, an interlock switch 32, which detects whether the upper frame 9 is opened or closed with respect to the main frames 8, is arranged on the main frame 8 on the same side as the upper frame 9 that includes the torque limiter 28. As shown in FIG. 14, the interlock switch 32 includes a movable lever 35 and a base 36. The movable lever 35 is pressed in the direction of an arrow G and the interlock switch 32 is turned on. When the upper frame 9 is moved from the retracting position to the writing operation position and closed, a protruding unit 54 of the upper cover 50 that is attached to the upper frame 9 directly presses and turns on the interlock switch 32. Due to this, closing of the upper frame 9 can be identified.

Figure 15:
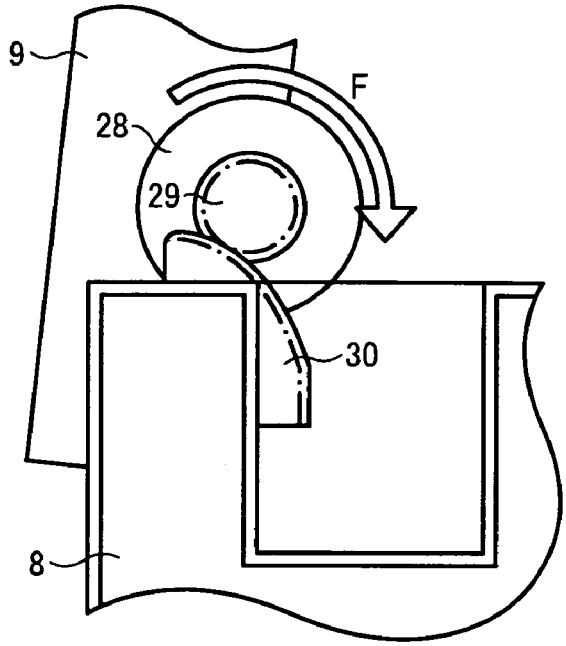
FIG. 15 is a schematic of the vicinity of a torque limiter when the upper frame is turned from the retracting position to the writing operation position.

FIG. 15 is a schematic of a periphery of the torque limiter 28 when the upper frame 9 is turned with respect to the main frame 8 at the time of removing the photosensitive drums 2 during maintenance.

When the gear 29 of the torque limiter 28 rotates in the direction of the arrow F, a torque which is larger than or equal to a predetermined torque (a force that is at least larger than the gravitational force that acts on portions such as the optical writer 70 etc. that can turn, along with the upper frame 9, with respect to the main frame 8) in the direction of the arrow F needs to be added to the torque limiter 28. If the added torque is less than the predetermined torque, a high torque is exerted by the torque limiter 28. Due to this, the gear 29 cannot rotate and remains fitted to the rack 30 at the same position. In other words, the torque limiter 28 regulates turning of the upper frame 9 such that even if the upper frame 9 is biased in a closing direction with respect to the main frame 8 by using the bias force that is less than a predetermined bias force (predetermined torque), the upper frame 9 does not turn towards the closing direction.

Due to this, even if the user ceases to hold the upper frame 9 during a process to move the upper frame 9 from the retracting position to the writing operation position, the gear 29 attempts to rotate in the direction of the arrow F shown in FIG. 15 and the torque limiter 28 exerts a high torque. Due to this, the gear 29 and the rack 30 remain fitted at the same position and the upper frame 9 does not close due to the gravitational force that acts on the upper frame 9 and the optical writer 70. Thus, the user can replace the photosensitive drums 2 using both the hands and maintainability is enhanced.

Further, a torque which is larger than or equal to the predetermined torque is added to the torque limiter 28 in the closing direction of the upper frame 9 with respect to the main frame 8, thus causing the torque limiter 28 to rotate. The rotating torque limiter 28 ceases to exert the torque on the gear 29, thus enabling the gear 29 to rotate. Thus, manually holding down the upper frame 9 in the closing direction causes the gear 29 to rotate and move along on the rack 30 and the upper frame 9 is turned in the closing direction, thus enabling to close the upper frame 9 with respect to the main frame 8.

When the gear 29 rotates in a direction that is opposite the direction of the arrow F, the torque exerted on the gear 29 is negligible and the gear 29 can rotate and move along on the rack 30. Thus, because the torque exerted on the gear 29 by the torque limiter 28 is nearly zero at the time of opening the upper frame 9, when opening the upper frame 9, the gear 29 rotates and moves along on the rack 30 in the opposite direction of the arrow F shown in FIG. 9 due to a force that is less than the force at the time of closing the upper frame 9. Thus, the upper frame 9 can be easily opened.

Because the torque of the torque limiter 28 is constant regardless of a closing speed of the upper frame 9, if the user closes the upper frame 9 with brute force, the upper frame 9 is closed forcefully. However, in the present embodiment, the air cylinder 16 is used as a shock absorbing unit such that the bias force increases depending on the closing speed. Thus, because the shock at the time of closing the upper frame 9 can be appropriately absorbed, warping and damage to the optical writer 70 can be prevented.

Figure 16:
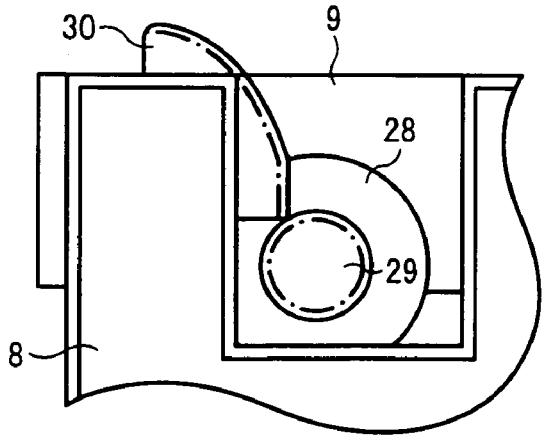
FIG. 16 is a schematic of the vicinity of the torque limiter when the upper frame is completely closed with respect to main frames.

FIG. 16 is a schematic of the vicinity of the torque limiter 28 when the upper frame 9 is closed with respect to the main frames 8. When the upper frame 9 is closed, the rack 30 and the gear 29 are separated. Separating the rack 30 and the gear 29 prevents occurrence of the torque of the torque limiter 28 and the torque becomes nearly zero, thereby enabling to curb a deformation of the upper frame 9 due to exertion of the torque over a long time period and a subsequent erroneous operation of the interlock switch 32 that detects whether the upper frame 9 is opened or closed. In other words, even if the upper frame 9 is closed, the interlock switch 32 cannot be pressed by the upper frame 9 due to deformation of the upper frame 9 and the interlock switch 32 detects the upper frame 9 as being open. However, separation of the gear 29 and the rack 30 enables to curb such an erroneous operation of the interlock switch 32.

Figure 17:
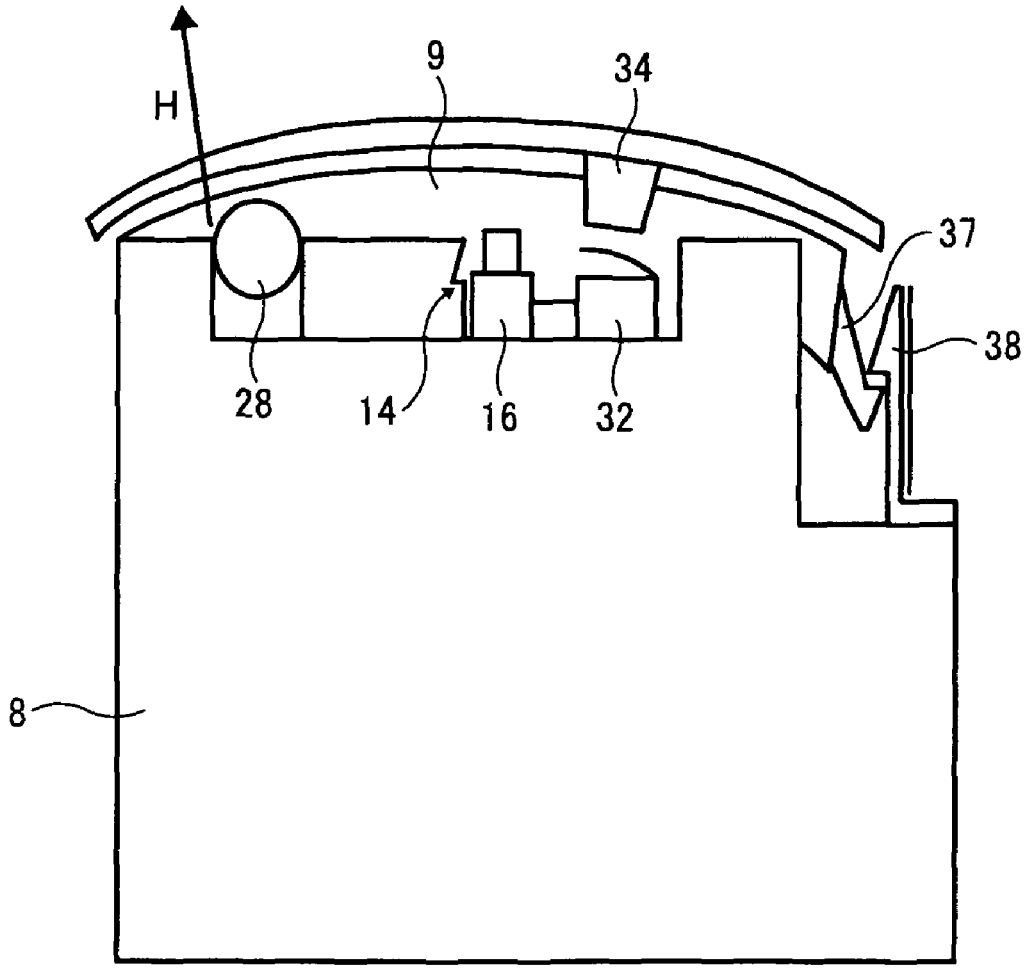
FIG. 17 is a schematic of an overview when the bent upper frame is completely closed with respect to a main body of the image forming apparatus.

To explain specifically with reference to FIG. 17, when moving the optical writer 70 to the writing operation position, the upper frame 9 is biased in the direction of an arrow H due to the bias force of the torque limiter 28, thus causing a bend in the upper frame 9. Due to this, after moving the upper frame 9 to the writing operation position, a latch 37 that is fixed to the upper frame 9 is hitched to a front frame 38. Due to this, the bent upper frame 9 is completely closed with respect to the main body of the printer. In such a closed condition, because the protruding unit 54 is in a marginally upward direction than an appropriate position, the interlock switch 32 does not operate even if the upper frame 9 is completely closed. To overcome the drawback, when the upper frame 9 is moved to the writing operation position and closed, the rack 30 and the gear 29 are separated from each other and the torque of the torque limiter 28 is made nearly equal to zero. Due to this, bending of the upper frame 9 is curbed and the interlock switch 32 can be pressed using the protruding unit 54.

For maintaining the closed condition of the upper frame 9 even if the user ceases to manually hold the upper frame 9, a torsion spring, which biases the upper frame 9 in the opening direction regardless of a position of the upper frame 9, can also be arranged on the fulcrum shaft 18. However, when using the torsion spring, during a closed state of the upper frame 9, a significant bias force is constantly exerted at an operation point of the upper frame 9 with the fixed end of the torsion spring and a spring of the main frame 8. Due to this, a likelihood of deformation of the upper frame 9 increases. Thus, the torque limiter 28 is desirably used as a mechanism that maintains the closed state of the upper frame 9 even if the user ceases to manually hold the upper frame 9 when replacing the photosensitive drums 2 using both the hands.

In the present embodiment, for effectively using the space and enhancing compactness of the printer, the torque limiter 28 is arranged on the upper frame 9. However, the torque limiter 28 can also be arranged on the main frame 8. When using the structure mentioned earlier, the rack 30 is arranged on the side having the upper frame 9 and the upper frame 9 is manually held in the closing direction to exert on the torque limiter 28, the torque that is larger than or equal to the predetermined torque. Due to this, the torque limiter 28 rotates and causes the gear 29 to rotate. Consequently, the rack 30 moves on the gear 29 and the upper frame 9 can turn in the closing direction.

According to the embodiments mentioned earlier, the printer in the form of the image forming apparatus includes the photosensitive drums 2, the optical writer 70, and the upper frame 9. The photosensitive drums 2 are latent image-carrying members that carry latent images. The optical writer 70 is a latent image writing unit that writes the latent images on the photosensitive drums 2. The upper frame 9 is a holding member that can turn, while holding the optical writer 70, centered on the fulcrum shaft 18 that is a turning axis arranged on a main body of the image forming apparatus, between the retracting position that is an opening position with respect to the main body of the image forming apparatus and the writing operation position that is a closing position. The printer includes the holding units 14 and 15, the spring 27, and the air cylinder 16. The holding units 14 and 15 are positioning units that are arranged on the main body of the image forming apparatus and that decide a position of the optical writer 70 with respect to the photosensitive drums 2 when the upper frame 9 is at the writing operation position. The spring 27 is a biasing unit that biases the optical writer 70 and causes the optical writer 70 to touch the holding units 14 and 15. The air cylinder 16 is a shock absorbing unit that absorbs a shock that is received by the upper frame 9 and the optical writer 70 when the upper frame 9 is moved from the retracting position to the writing operation position. In the embodiments mentioned earlier, when the upper frame 9 is at the writing operation position, a bias exerted by the spring 27 causes the supporting units 10 and 11 of the optical writer 70 to touch the holding units 14 and 15 that are arranged on the main frames 8. Due to this, the position of the optical writer 70 with respect to the photosensitive drums 2 can be precisely decided. Further, the air cylinder 16 can absorb the shock that is received by the upper frame 9 and the optical writer 70 when the upper frame 9 is moved from the retracting position to the writing operation position. Thus, when the upper frame 9 is closed with respect to the main body of the image forming apparatus, occurrence of significant warping or deformation due to the shock received by the upper frame 9 and the optical writer 70 can be curbed. In other words, apart from biasing the supporting units 10, 11 of the optical writer 70 and causing the supporting units 10, 11 to touch the holding units 14, 15 that are the positioning units inside the main body of the image forming apparatus, the shock received by the upper frame 9 and the optical writer 70 is absorbed and occurrence of significant warping is prevented. Due to this, the optical writer 70 can be precisely decided compared to a structure that does not absorb the shock. Accordingly, reduction in the writing position accuracy of the optical writer 70 can be curbed.

According to the second embodiment, the torsion spring is included that is a second biasing unit that biases the upper frame 9 in the opening direction with respect to the main body of the image forming apparatus. Due to this, even if the user ceases to manually hold the upper frame 9, a closed state of the upper frame 9 can be maintained. Thus, the user can replace the photosensitive drums 2 using both the hands and maintainability is enhanced.

Further, according to the second embodiment, the torque limiter is included such that the upper frame 9 does not turn in the closing direction with respect to the main body of the image forming apparatus due to the bias force that is less than the predetermined bias force (predetermined torque), and the upper frame 9 can turn in the closing direction due to the bias force that is larger than the predetermined bias force. Due to this, even if the user ceases to manually hold the upper frame 9, the torque limiter 28 can regulate turning of the upper frame in the closing direction due to the gravitational force that is less than the predetermined bias force and that acts on the upper frame 9 and the optical writer 70. Thus, because the closed state of the upper frame 9 can be maintained, the user can replace the photosensitive drums 2 using both the hands and maintainability is enhanced. Further, warping of the upper frame 9 etc. can be curbed compared to when the torsion spring is used for maintaining an opened state of the upper frame 9.

According to the second embodiment, arranging the torque limiter 28 on the upper frame 9 enables to enhance compactness of the main body of the image forming apparatus and maintainability of the photosensitive drums 2.

According to the second embodiment, the printer includes the main frames 8 and the interlock switch 32. The main frames 8 is a pair of frames that are arranged on the main body of the image forming apparatus and that are perpendicular to a photosensitive drum axial direction. The interlock switch 32 is an opening/closing detector that is arranged on one of the main frames 8 and that detects opening and closing of the upper frame 9. The torque limiter 28 is arranged on the same side as the main frame 8 on which the interlock switch 32 of the upper frame 9 is arranged. Due to this, when a side of the upper frame 9 that is difficult to close due to the torque limiter 28 is closed, the interlock switch 32 is turned on and can detect closing of the upper frame 9. Thus, arranging the torque limiter 28 enables to prevent a closing defect.

Further, according to the second embodiment, when the upper frame 9 is completely closed with respect to the main body of the image forming apparatus, the torque exerted on the torque limiter 28 becomes nearly equal to zero. Due to this, the upper frame 9 does not get deformed even if the upper frame 9 is closed with respect to the main body of the image forming apparatus for a long time period. Thus, when the upper frame 9 is closed with respect to the main body of the image forming apparatus, the interlock switch 32 can reliably confirm closing of the upper frame 9.

Further, according to the second embodiment, the printer includes the gear 29 that is arranged on the torque limiter 28 and the rack 30 that meshes with the gear 29. The gear 29 and the rack 30 are separated when the upper frame 9 is completely closed with respect to the main body of the image forming apparatus. Due to this, when the upper frame 9 is completely closed with respect to the main body of the image forming apparatus, the torque of the torque limiter 28 becomes nearly equal to zero. Thus, deformation of the upper frame 9 due to exertion of the torque for a long time period can be curbed and erroneous operation of the interlock switch 32 due to the deformation of the upper frame 9 can also be curbed.

Further, according to the embodiments mentioned earlier, when an angle formed by the upper frame 9 and the main body of the image forming apparatus is less than a predetermined angle, in other words, when a distance between the upper frame 9 and the main body of the image forming apparatus has reduced than a predetermined distance, the air cylinder 16 that is the shock absorbing unit biases the upper frame 9 in the opening direction with respect to the main body of the image forming apparatus. Due to this, the air cylinder 16 can absorb the shock that is received by the upper frame 9 and the optical writer 70 when the upper frame 9 is moved from the retracting position to the writing operation position, thus enabling to curb significant warping or deformation of the upper frame 9 and the optical writer 70.

Further, according to the embodiments mentioned earlier, the air cylinder 16 is a third biasing unit that exerts the bias force on the optical writer 70. Due to this, the shock exerted on the optical writer 70 can be effectively absorbed.

According to the embodiments mentioned earlier, the bias force of the spring 27 is larger than the bias force of the air cylinder 16 that is the third biasing unit. Due to this, a displacement in the position of the optical writer 70 due to vibrations of the main body of the image forming apparatus during image formation or vibrations during transportation can be curbed and the position of the optical writer 70 can be precisely decided.

Further, according to the embodiments mentioned earlier, the bias force of the air cylinder 16 becomes nearly equal to zero after lapse of the predetermined time period when the upper frame 9 is closed with respect to the main body of the image forming apparatus. Due to this, the bias force exerted on the optical writer 70 is provided only by the weight of the spring 27 and the upper frame 9 (the gravitational force that acts on the upper frame 9 etc.) and by the cylinder biasing spring 21. Thus, the position of the optical writer 70 can be precisely decided using the holding unit 14 of the main body of the image forming apparatus.

Further, according to the embodiments mentioned earlier, the air cylinder 16 is a fluid damper that uses a fluid. Thus, due to characteristics of a commonly known fluid damper, the air cylinder 16 can absorb the shock with greater force when a turning speed at the time of closing the upper frame 9 is high, and can absorb the shock with lesser force when the turning speed at the time of closing the upper frame 9 is less. In other words, when the turning speed is high and is likely to cause significant warping or deformation of the upper frame 9 and the optical writer 70, the air cylinder 16 can sufficiently absorb the shock with greater force. When the turning speed is less, the air cylinder can absorb the shock with lesser force. Thus, difficulty in closing the upper frame 9 with respect to the main body of the image forming apparatus due to the bias force of the air cylinder 16 can be curbed.

Further, according to the embodiments mentioned earlier, the air cylinder 16 at least includes the piston 19, the compression chamber 22 such that the volume of the compression chamber 22 reduces due to pressing of the piston 19, and the orifice 23 that communicates between the compression chamber 22 and outside of the air cylinder 16. Pressing the piston 19 compresses the compression chamber 22 and the amount of air released to outside the air cylinder 16 via the orifice 23 can be controlled by controlling a section of the orifice 23. Thus, the bias force of the air cylinder 16 can be adjusted using a simple structure.

Further, according to the embodiments mentioned earlier, the air cylinder 16 includes the communicating hole 24 and the communicating hole-opening/closing member 25. The communicating hole 24 communicates between the compression chamber 22 and outside of the air cylinder 16 separately from the orifice 23. The communicating hole-opening/closing member 25 opens and closes the communicating hole 24. Thus, the communicating hole 24 is included apart from the orifice 23 and the communicating hole-opening/closing member 25 opens the communicating hole 24 at the time of opening the upper frame 9. Due to this, the air from the outside is transmitted to inside the compression chamber 22 rapidly compared to when only the orifice 23 is included. Consequently, the air inside the compression chamber 22 expands and the bias force of the air cylinder 16 can be rapidly restored. Thus, rapidly restoring the bias force of the air cylinder 16 enables to quickly deal with the shock that occurs when the optical writer 70 is closed again.

Further, according to the embodiments mentioned earlier, the communicating hole 24 is arranged on the piston 19. Upon being pressed by the optical writer 70, the communicating hole-opening/closing member 25 touches the piston 19 and closes the communicating hole 24, thereby removing a necessity to include an exclusive actuator for driving the communicating hole-opening/closing member 25 that opens and closes the communicating hole 24. Due to this, a cost of the image forming apparatus can be reduced and the internal structure of the main body of the image forming apparatus can be simplified.

Further, according to the embodiments mentioned earlier, the printer includes the spring 26 in the opposite direction of the direction in which the communicating hole-opening/closing member 25 is pressed by the optical writer 70. The spring 26 is a fourth biasing unit that biases the communicating hole-opening/closing member 25. Due to this, along with opening of the upper frame 9, the optical writer 70 separates from the communicating hole-opening/closing member 25. Thus, because the communicating hole-opening/closing member 25 can be separated from the piston 19 by the bias force of the spring 26, the communicating hole 24 can be opened using a simple structure.

Further, according to the embodiments mentioned earlier, the bias force of the spring 27 is larger than the bias force of the spring 26. Due to this, a displacement in the position of the optical writer 70 due to vibrations of the main body of the image forming apparatus during image formation or vibrations during transportation can be curbed and the position of the optical writer 70 can be precisely determined.

In the embodiments mentioned earlier, the shock received by the upper frame 9 and the optical writer 70 can also be absorbed by using a spring as the shock absorbing unit instead of using the air cylinder 16 as the shock absorbing unit that absorbs the shock. The spring thus used is linked to the interlock switch 32 that recognizes opening and closing of the upper frame 9 and when closing the upper frame 9, the spring is retracted to ensure that the spring does not touch the upper frame 9 and the optical writer 70. Due to this, after absorbing the shock, the spring does not exert a bias on the upper frame 9 in the opening direction and the position of the optical writer 70 can be decided further precisely.

In the present invention, when a holding member is at a closing position, a latent image writing unit is caused to touch positioning units inside a main body of an image forming apparatus by a bias of a biasing unit. Due to this, a position of the latent image writing unit with respect to the main body of the image forming apparatus can be precisely determined. Further, a shock absorbing unit can absorb a shock that is received by the holding member and the latent image writing unit when the holding member is moved from an opening position to the closing position. Thus, when the holding member is closed with respect to the main body of the image forming apparatus, occurrence of significant warping due to the shock received by the holding member and the latent image writing unit can be curbed.

As described above, according to an aspect of the present invention, a latent image writing unit is biased and caused to touch positioning units inside a main body of an image forming apparatus. Further, a shock received by a holding member and the latent image writing unit is absorbed and occurrence of significant warping is curbed. Thus, a position of the latent image writing unit can be precisely decided compared to a structure in which the shock is not absorbed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a photosensitive image carrier;

a latent image writing unit that writes a latent image on the image carrier;

a holding unit for holding the latent image writing unit, which is configured to turn centered on a turning axis that is arranged on a main body of the image forming apparatus between an opening position and a closing position with respect to the main body;

a positioning unit that is arranged on the main body and that positions the latent image writing unit with respect to the image carrier, when the holding unit is at the closing position;

a first biasing unit that biases the latent image writing unit and causes the latent image writing unit to make a contact with the positioning unit; and a shock absorbing unit that absorbs a shock that is received by the holding unit and the latent image writing unit when the holding unit is moved from the opening position to the closing position, wherein the shock absorbing unit is recessed in the positioning unit, and the shock absorbing unit functions to bias the holding unit in an opening direction with respect to the main body when an angle formed by the holding unit and the main body of the image forming apparatus is smaller than a predetermined value.

2. The image forming apparatus according to claim 1, further comprising a torque limiter with which the holding unit does not turn by a bias force that is smaller than a predetermined bias force in a closing direction with respect to the main body of the image forming apparatus and the holding unit turns by a bias force that is larger than the predetermined bias force in the closing direction.

3. The image forming apparatus according to claim 2, wherein the torque limiter is arranged on the holding unit.

4. The image forming apparatus according to claim 2, further comprising:

a pair of frames arranged on the main body in a direction perpendicular to a latent image-carrying member axial direction; and an opening/closing detector that is arranged on one of the frames and that detects opening and closing of the holding unit, wherein the torque limiter is arranged on a same side as the frame on which the opening/closing detector of the holding unit is arranged.

5. The image forming apparatus according to claim 2, wherein a torque exerted on the torque limiter becomes nearly zero when the holding unit is completely closed with respect to the main body of the image forming apparatus.

6. The image forming apparatus according to claim 2, further comprising:

a gear arranged on the torque limiter; and a rack that meshes with the gear, wherein the gear and the rack are separated when the holding unit is completely closed with respect to the main body of the image forming apparatus.

7. The image forming apparatus according to claim 1, wherein the shock absorbing unit biases the holding unit in the opening direction with respect to the main body of the image forming apparatus.

8. The image forming apparatus according to claim 1, wherein the shock absorbing unit applies a bias force on the latent image writing unit.

9. The image forming apparatus according to claim 8, wherein the bias force of the first biasing unit applied to the latent image writing unit is larger than the bias force of the shock absorbing unit applied to the latent image writing unit.

10. The image forming apparatus according to claim 1, wherein the bias force of the shock absorbing unit becomes nearly equal to zero after lapse of a predetermined time period when the holding unit is closed with respect to the main body of the image forming apparatus.

11. An image forming apparatus, comprising:

a photosensitive image carrier;

a latent image writing unit that writes a latent image on the image carrier;

a holding unit for holding the latent image writing unit, which is configured to turn centered on a turning axis that is arranged on a main body of the image forming apparatus between an opening position and a closing position with respect to the main body;

a positioning unit that is arranged on the main body and that positions the latent image writing unit with respect to the image carrier, when the holding unit is at the closing position;

a first biasing unit that biases the latent image writing unit and causes the latent image writing unit to make a contact with the positioning unit; and a shock absorbing unit that absorbs a shock that is received by the holding unit and the latent image writing unit when the holding unit is moved from the opening position to the closing position, wherein the shock absorbing unit functions as a second biasing unit that biases the holding unit in the opening direction with respect to the main body when an angle formed by the holding unit and the main body of the image forming apparatus is smaller than a predetermined value, and wherein the second biasing unit is a fluid damper that uses a fluid.

12. The image forming apparatus according to claim 11, wherein the fluid damper includes an air cylinder, and the air cylinder includes at least a piston, a compression chamber, a volume whereof is reduced upon being pressed by the piston, and an orifice that communicates between the compression chamber and outside of the air cylinder.

13. The image forming apparatus according to claim 12, further comprising:

a communicating hole that communicates between the compression chamber and outside of the air cylinder separately from the orifice; and a communicating hole-opening/closing unit that opens and closes the communicating hole.

14. The image forming apparatus according to claim 13, wherein the communicating hole is arranged on the piston, and the communicating hole-opening/closing unit touches the piston, upon being pressed by the latent image writing unit, and closes the communicating hole.

15. The image forming apparatus according to claim 14, further comprising a third biasing unit arranged in a direction opposite to the direction in which the communicating hole-opening/closing unit is pressed by the latent image writing unit and that biases the communicating hole-opening/closing unit.

16. The image forming apparatus according to claim 15, wherein the bias force of the first biasing unit is larger than a bias force of the third biasing unit.

* * * * *